US008044613B2

(12) United States Patent
Okawa et al.

(10) Patent No.: US 8,044,613 B2
(45) Date of Patent: Oct. 25, 2011

(54) DISCHARGE LAMP LIGHTING DEVICE, CONTROL METHOD THEREOF, AND PROJECTOR

(75) Inventors: Kazuo Okawa, Matsumoto (JP); Kentaro Yamauchi, Ashiya (JP); Tetsuo Terashima, Chino (JP); Takeshi Takezawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 428 days.

(21) Appl. No.: 12/401,301

(22) Filed: Mar. 10, 2009

(65) Prior Publication Data

US 2009/0237009 A1 Sep. 24, 2009

(30) Foreign Application Priority Data

Mar. 24, 2008 (JP) ..... 2008-075906

(51) Int. Cl.
*H05B 41/00* (2006.01)

(52) U.S. Cl. ..... 315/326; 315/291; 315/209 R

(58) Field of Classification Search ..... 315/194, 315/209 R, 291, 307, 308, 326, 361, 362, 315/360

See application file for complete search history.

(56) References Cited

U.S. PATENT DOCUMENTS

| | | | | |
|---|---|---|---|---|
| 6,118,521 | A * | 9/2000 | Jung et al. | 356/73 |
| 6,522,086 | B2 * | 2/2003 | Gemunder et al. | 315/291 |
| 2007/0278963 | A1 | 12/2007 | Wu et al. | |

FOREIGN PATENT DOCUMENTS

| | | | |
|---|---|---|---|
| JP | A-6-34568 | | 2/1994 |
| JP | A-11-144887 | | 5/1999 |
| JP | A-2002-100491 | | 4/2002 |
| JP | A-2002-532866 | | 10/2002 |
| WO | WO 00/36882 | A1 | 6/2000 |
| WO | WO 04/002200 | A1 | 12/2003 |

* cited by examiner

*Primary Examiner* — Douglas W Owens
*Assistant Examiner* — Jianzi Chen
(74) *Attorney, Agent, or Firm* — Oliff & Berridge PLC

(57) ABSTRACT

A discharge lamp lighting device includes: a power control circuit outputting DC current; an AC conversion circuit generating and outputting discharge lamp driving AC current by inverting the polarity of the DC current at a predetermined timing; a control circuit performing an AC conversion control process of controlling a polarity inversion timing of the discharge lamp driving AC current on the AC conversion circuit and performing an interval current control process of controlling a current value of the DC current every polarity inversion timing interval on the power control circuit; a detection unit detecting a discharge lamp driving voltage at the time of normal lighting; a history information storage periodically storing history information of the detected discharge lamp driving voltage, a statistics processing unit statistically processing the stored history information every predetermined period; and a statistical information storage storing information having been subjected to the statistical process as statistical information. Here, the control circuit sets and controls at least one of a frequency, a duty ratio, and a waveform of the discharge lamp driving AC current on the basis of a time-dependent tendency of the statistical information.

10 Claims, 7 Drawing Sheets

| TIME (h) | AVERAGE VALUE(V) | MOVING AVERAGE VALUE(V) | STANDARD ERROR(V) |
|---|---|---|---|
| 1 | 73.7 | | |
| 2 | 73.9 | | |
| 3 | 74.0 | 73.9 | |
| 4 | 73.7 | 73.9 | |
| 5 | 74.2 | 74.0 | 0.17590 |
| 6 | 74.6 | 74.2 | 0.28713 |
| 7 | 74.2 | 74.3 | 0.28572 |
| 8 | 74.0 | 74.2 | 0.29695 |
| 9 | 73.5 | 73.9 | 0.28024 |
| 10 | 75.3 | 74.3 | 0.65306 |
| 11 | 73.4 | 74.1 | 0.74596 |
| 12 | 75.5 | 74.7 | 0.85268 |
| 13 | 74.7 | 74.5 | 0.61553 |
| 14 | 75.4 | 75.2 | 0.49093 |
| 15 | 75.4 | 75.2 | 0.20781 |

DISCHARGE LAMP LIGHTING DEVICE, CONTROL METHOD THEREOF, AND PROJECTOR

The entire disclosure of Japanese Patent No. 2008-075906 filed Mar. 24, 2008 is expressly incorporated by reference herein.

BACKGROUND

1. Technical Field

The present invention relates to a discharge lamp lighting device, a control method thereof, and a projector.

2. Related Art

Discharge lamps such as high-pressure mercury lamps or metal halide lamps are used as a light source of projectors. The optimal driving conditions (a frequency, a duty ratio, and a waveform of driving current) of the discharge lamps depend on statuses of the discharge lamps. For example, just after starting the lighting and after a certain time passes since the lighting, the optimal driving conditions change. The optimal driving conditions are different in a discharge lamp having a short used time and a discharge lamp of which the lifetime almost expires. The optimal driving conditions change depending on the types of the discharge lamps.

The use of the discharge lamps under non-optimal driving conditions causes the blackening or devitrification of discharge tubes. It also causes a flicker. For example, when such discharge lamps are used in a projector, the brightness of a projected image changes in the course of using the projector.

Accordingly, a discharge lamp lighting device has been suggested which has a control circuit having plural driving conditions set in advance and which can properly select the driving conditions depending on a lighting status of a discharge lamp.

An example of such a known discharge lamp lighting device is disclosed in JP-A-2002-532866.

As described in JP-A-2002-532866, the lighting time of several hundreds hours to several thousand hours is required for detecting a continuous increasing phenomenon of a discharge lamp driving voltage. The negligence of the continuous increasing phenomenon of the discharge lamp driving voltage causes the brightness of the discharge lamp to be lowered. This is a problem particularly for an application intended to suppress the change in brightness of the discharge lamp as small as possible for a long time, such as a projector.

However, since a user usually uses the discharge lamps continuously for at most several hours, it is too short to detect the continuous increasing phenomenon of the discharge lamp driving voltage. Therefore, the controlling of the lighting conditions depending on the lighting status of the discharge lamp as in the discharge lamp lighting device described in JP-A-2002-532866 is not a satisfactory countermeasure.

SUMMARY

An advantage of some aspects of the invention is that it provides a discharge lamp lighting device that can set a driving condition of a discharge lamp on the basis of a time-dependent tendency for a long time and a projector employing the discharge lamp lighting device.

According to an aspect of the invention, there is provided a discharge lamp lighting device including: a power control circuit outputting DC current; an AC conversion circuit generating and outputting discharge lamp driving AC current by inverting the polarity of the DC current at a predetermined timing; a control circuit performing an AC conversion control process of controlling a polarity inversion timing of the discharge lamp driving AC current on the AC conversion circuit and performing an interval current control process of controlling a current value of the DC current every polarity inversion timing interval on the power control circuit; a detection unit detecting a discharge lamp driving voltage at the time of normal lighting; a history information storage periodically storing history information of the detected discharge lamp driving voltage; a statistics processing unit statistically processing the stored history information every predetermined period; and a statistical information storage storing information having been subjected to the statistical process as statistical information. Here, the control circuit sets and controls at least one of a frequency, a duty ratio, and a waveform of the discharge lamp driving AC current on the basis of a time-dependent tendency of the statistical information.

According to this configuration, the control circuit can more properly set the driving conditions of the discharge lamp by setting and controlling at least one of the frequency, the duty ratio, and the waveform of the discharge lamp driving AC current on the basis of the time-dependent tendency of the statistical information. Accordingly, it is possible to embody a discharge lamp lighting device that can stably drive a discharge lamp for a long time.

The duty ratio represents a ratio of time of a first polarity to one period of the discharge lamp driving AC current in which a first polarity and a second polarity are inverted.

In the discharge lamp lighting device, the history information storage and the statistical information storage may hold the information after putting out the discharge lamp.

In the discharge lamp lighting device, the statistics processing unit may erase the history information used for the statistical process.

In the discharge lamp lighting device, the statistical process may include an average process of taking an average value of the history information every predetermined period.

In the discharge lamp lighting device, the statistical process may include a moving average process of taking a moving average value on the basis of a predetermined number of latest average values.

In the discharge lamp lighting device, the statistical process may include a standard error process of taking a standard error on the basis of a predetermined number of latest moving average values.

In the discharge lamp lighting device, the statistical process may include at least one of a standard deviation process of taking a standard deviation of the history information every predetermined period and a variance process of taking a variance of the history information every predetermined period.

In the discharge lamp lighting device, the statistical process may include at least one of a maximum value process of taking a maximum value of average values on the basis of a predetermined number of latest average values and a minimum value process of taking a minimum value of the average values on the basis of a predetermined number of latest average values.

In the discharge lamp lighting device, the control circuit may perform an AC conversion control process of lowering the frequency of the discharge lamp driving AC current when the moving average value is equal to or greater than an upper limit threshold value.

In the discharge lamp lighting device, the control circuit may perform an AC conversion control process of raising the frequency of the discharge lamp driving AC current when the moving average value is equal to or less than a lower limit threshold value.

In the discharge lamp lighting device, the control circuit may perform an AC conversion control process of changing the duty ratio of the discharge lamp driving AC current in a periodic pattern when one of the standard deviation, the variance, and the standard error is equal to or greater than a threshold value.

In the discharge lamp lighting device, the control circuit may perform an interval current control process of changing the waveform of the discharge lamp driving AC current when a difference between the maximum value and the minimum value is equal to or greater than a threshold value.

According to another aspect of the invention, there is provided a projector including the above-mentioned discharge lamp lighting device.

According to another aspect of the invention, there is provided a control method of a discharge lamp lighting device having a power control circuit outputting DC current and an AC conversion circuit generating and outputting discharge lamp driving AC current by inverting the polarity of the DC current at a predetermined timing, the control method including: performing an AC conversion control process of controlling a polarity inversion timing of the discharge lamp driving AC current on the AC conversion circuit and performing an interval current control process of controlling a current value of the DC current every polarity inversion timing interval on the power control circuit; detecting a discharge lamp driving voltage at the time of normal lighting; periodically storing history information of the detected discharge lamp driving voltage; statistically processing the stored history information every predetermined period; and storing information having been subjected to the statistical process as statistical information. Here, the performing of an AC conversion control process and an interval current control process includes setting at least one of a frequency, a duty ratio, and a waveform of the discharge lamp driving AC current on the basis of a time-dependent tendency of the statistical information.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
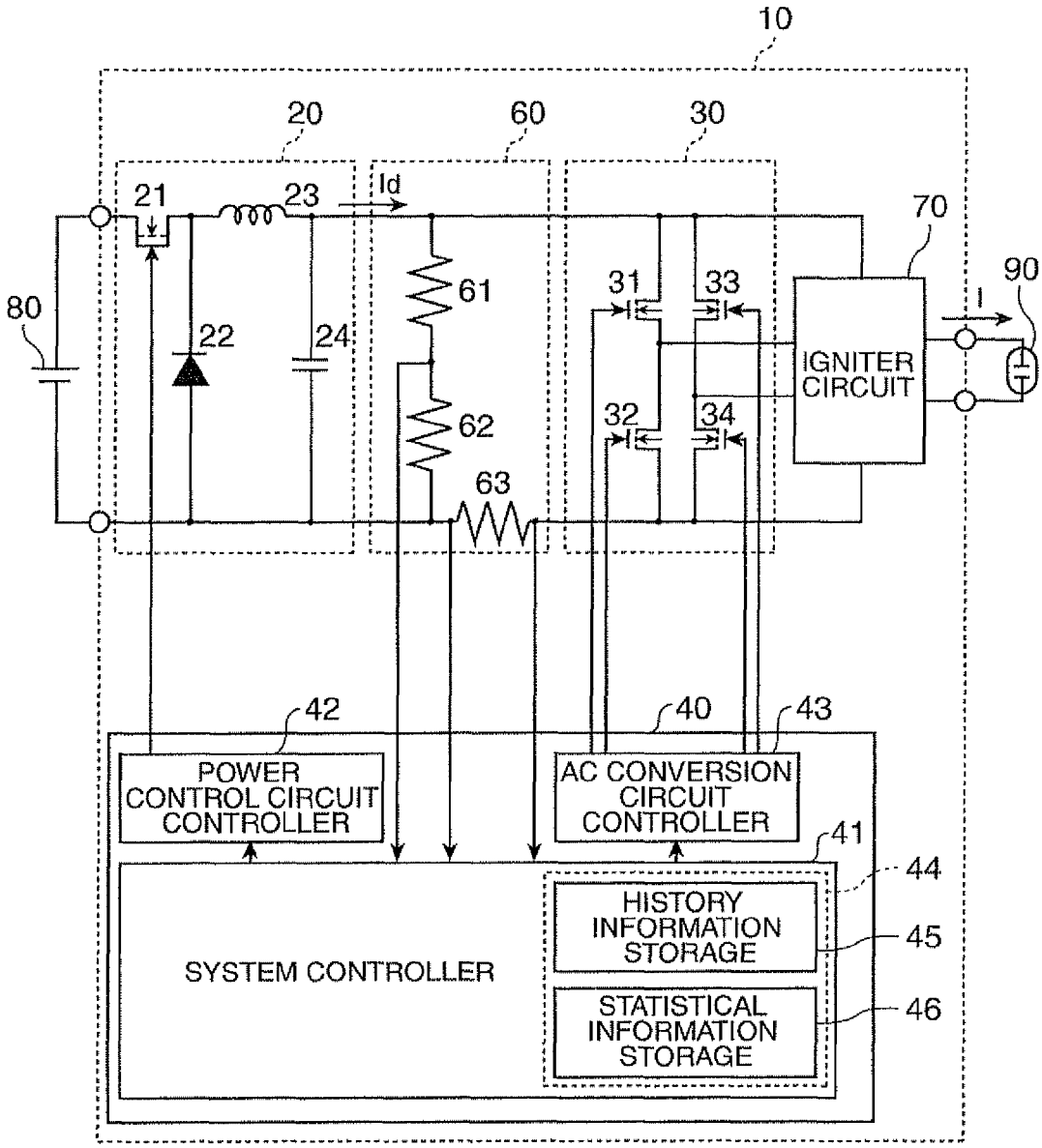
FIG. 1 is a diagram illustrating a circuit configuration of a discharge lamp lighting device according to an embodiment of the invention.

Hereinafter, exemplary embodiments of the invention will be described in detail with reference to the accompanying drawings, The embodiments to be described below are not intended to improperly define the details of the invention. It cannot be said that constituent elements to be described below are essential constituent elements of the invention. ps 1. Discharge Lamp Lighting Device ps (1) Circuit Configuration of Discharge Lamp Lighting Device FIG. 1 is a diagram illustrating a circuit configuration of a discharge lamp lighting device according to an embodiment of the invention.

The discharge lamp lighting device 10 includes a power control circuit 20. The power control circuit 20 controls the driving power supplied to the discharge lamp 90. In this embodiment, the power control circuit 20 is formed of a down-chopper circuit receiving a DC source 80 as an input, dropping the input voltage, and outputting DC current Id.

The power control circuit 20 may include a switching element 21, a diode 22, a coil 23, and a capacitor 24. The switching element 21 may be formed of, for example, a transistor. In this embodiment, one end of the switching element 21 is connected to a positive voltage side of the DC source 80 and the other end is connected to the cathode of the diode 22 and one end of the coil 23. One end of the capacitor 24 is connected to the other end of the coil 23 and the other end of the capacitor 24 is connected to the anode of the diode 22 and a negative voltage side of the DC source 80. The control terminal of the switching element 21 is supplied with a current control signal from a control circuit 40 to control ON and OFF of the switching element 21. For example, a PWM control signal may be used as the current control signal.

Here, when the switching element 21 is turned on, current flows in the coil 23 and energy is accumulated in the coil 23. Thereafter, when the switching element 21 is turned off, the energy accumulated in the coil 23 is discharged in a path passing through the capacitor 24 and the diode 22. As a result, the DC current Id corresponding to the ratio of the time when the switching element 21 is turned on is generated.

The discharge lamp lighting device 10 includes an AC conversion circuit 30. The AC conversion circuit 30 receives the DC current Id output from the power control circuit 20 as an input and generates and outputs discharge lamp driving current having an arbitrary frequency and an arbitrary duty ratio by inverting the polarity at a predetermined timing. The duty ratio is a ratio of time of a first polarity to one period of discharge lamp driving AC current I which is alternately inverted into a first polarity and a second polarity. In this embodiment, the AC conversion circuit 30 is formed of an inverter bridge circuit (full bridge circuit).

The AC conversion circuit 30 includes first to fourth switching elements 31 to 34 such as transistors, where the first and second switching elements 31 and 32 connected in series and the third and fourth switching elements 33 and 34 connected in series are connected to each other in parallel. The control terminals of the first to fourth switching elements 31 to 34 are supplied with a frequency control signal from the control circuit 40 to control ON and OFF of the first to fourth switching elements 31 to 34.

The AC conversion circuit 30 alternately inverts the polarity of the DC current Id input from the power control circuit 20 by alternately and repeatedly turning on and off the first and fourth switching elements 31 and 34 and the second and third switching elements 32 and 33, and generates and outputs the discharge lamp driving AC current I having controlled frequency and duty ratio from a common node of the first and second switching elements 31 and 32 and a common node of the third and fourth switching elements 33 and 34.

That is, the second and third switching elements 32 and 33 are turned off when the first and fourth switching elements 31 and 34 are turned on. In addition, the second and third switching elements 32 and 33 are turned on when the first and fourth switching elements 31 and 34 are turned off. Accordingly, when the first and fourth switching elements 31 and 34 are turned on, the discharge lamp driving AC current I sequentially flowing from one end of the capacitor 24 through the first switching element 31, the discharge lamp 90, and the fourth switching element 34 is generated. When the second and third switching elements 32 and 33 are turned on, the discharge lamp driving AC current I sequentially flowing from one end of the capacitor 24 through the third switching element 33, the discharge lamp 90, and the second switching element 32 is generated.

The discharge lamp lighting device 10 includes a control circuit 40. The control circuit 40 controls the current value, the frequency, the duty ratio, and the waveform of the discharge lamp driving AC current I by controlling the power control circuit 20 and the AC conversion circuit 30. The control circuit 40 performs an AC conversion control process of controlling the frequency and the duty ratio using the polarity conversion timing of the discharge lamp driving AC current I on the AC conversion circuit 30 and performs an interval current control process of controlling the current value of the output DC current Id every polarity conversion timing interval on the power control circuit 20. Here, the polarity conversion timing interval means a time between the polarity conversion timings temporally adjacent to each other. That is, one period of the discharge lamp driving AC current I includes two time intervals.

The configuration of the control circuit 40 is not particularly limited, but in this embodiment, the control circuit 40 includes a system controller 41, a power control circuit controller 42, and an AC conversion circuit controller 43. A part or all of the control circuit 40 may be formed of a semiconductor integrated circuit.

The system controller 41 controls the power control circuit 20 and the AC conversion circuit 30 by controlling the power control circuit controller 42 and the AC conversion circuit controller 43. The system controller 41 may control the power control circuit controller 42 and the AC conversion circuit controller 43 on the basis of the discharge lamp driving voltage and the discharge lamp driving AC current I detected by an operation detector 60 disposed in the discharge lamp lighting device 10 described later.

In this embodiment, the system controller 41 includes a memory unit 44. The memory unit 44 may be disposed independent of the system controller 41.

The system controller 41 may control the power control circuit 20 and the AC conversion circuit 30 on the basis of information stored in the memory unit 44. The memory unit 44 may store information on the current value, the frequency, the duty ratio, and the waveform of the discharge lamp driving AC current I.

In addition, the system controller 41 may also serve as a statistics processing unit statistically processing history information of the discharge lamp driving voltage detected by an operation detector 60 to be described later and stored in the memory unit 44 every predetermined period.

The memory unit 44 may also serve as a history information storage 45 periodically storing the history information of the discharge lamp driving voltage detected by the operation detector 60 to be described later.

The memory unit 44 may also serve as a statistical information storage 46 storing information statistically processed by the statistics processing unit as statistical information.

The history information storage 45 and the statistical information storage 46 may be configured to hold the information even after putting out the display lamp.

The power control circuit controller 42 controls the power control circuit 20 by outputting a current control signal to the power control circuit 20 on the basis of a control signal from the system controller 41.

The AC conversion circuit controller 43 controls the AC conversion circuit 30 by outputting an inversion control signal to the AC conversion circuit 30 on the basis of a control signal from the system controller 41.

The discharge lamp lighting device 10 may include an operation detector 60. The operation detector 60 may detect the operation of the discharge lamp 90 such as the discharge lamp driving voltage or the discharge lamp driving AC current I and output driving voltage information or driving current information. The operation detector 60 also serves as a detection unit detecting the discharge lamp driving voltage at the time of normal lighting. In this embodiment, the operation detector 60 includes first to third resistors 61 to 63.

The operation detector 60 is disposed in parallel to the discharge lamp 90, detects the discharge lamp driving voltage by the use of the voltages divided by the first and second resistors 61 and 62 connected in series, and detects the discharge lamp driving AC current I using the voltage appeared on the third resistor 63 connected in series to the discharge lamp 90.

The discharge lamp lighting device 10 may include an igniter circuit 70. The igniter circuit 70 operates only at the time of starting lighting the discharge lamp 90 and supplies the electrodes of the discharge lamp 90 with a high voltage (voltage higher than that of a normal control operation) necessary for breaking down the electrical insulation of the electrodes of the discharge lamp to form a discharge path at the time of starting lighting the discharge lamp 90. In this embodiment, the igniter circuit 70 is connected in parallel to the discharge lamp 90. ps (2) Control of Discharge Lamp Lighting Device A specific control example of the discharge lamp lighting device 10 according to this embodiment will be described now.

Figure 2:
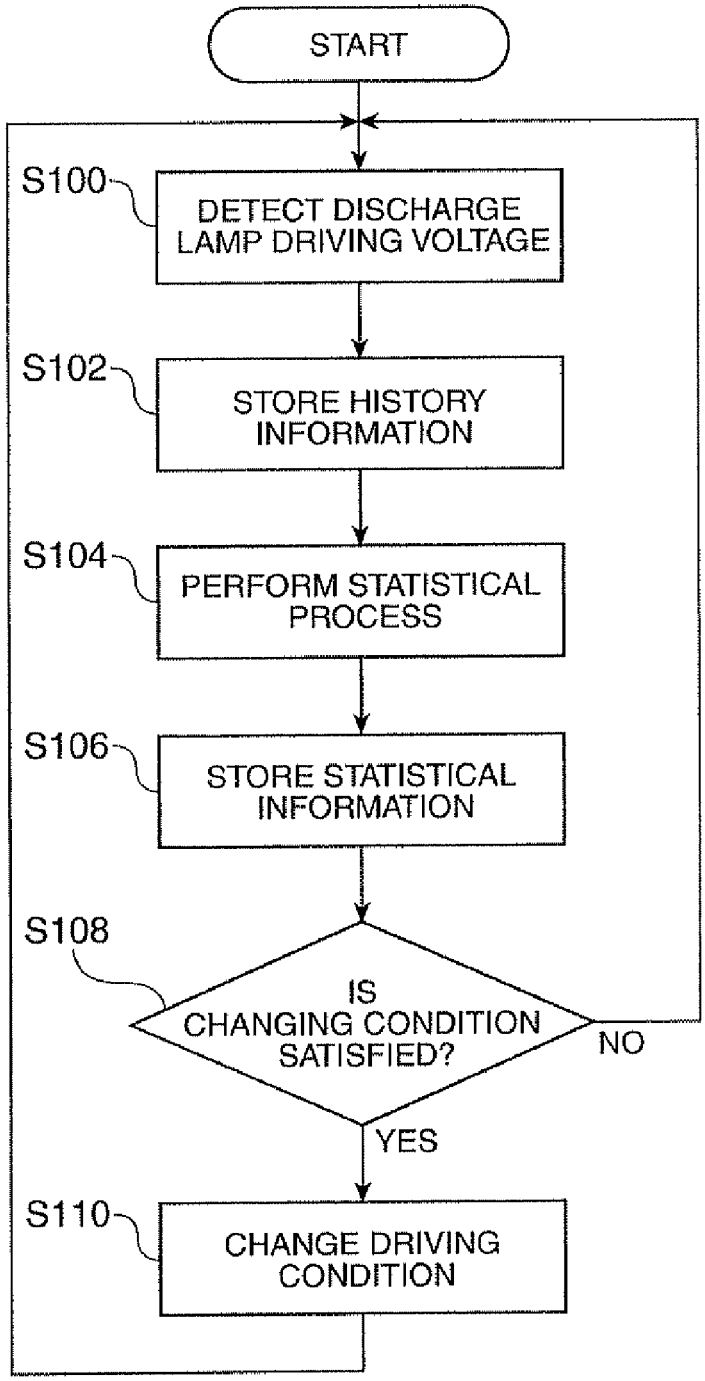
FIG. 2 is a diagram illustrating a control method of the discharge lamp lighting device according to the embodiment of the invention.

FIG. 2 is a flowchart schematically illustrating a control method of the discharge lamp lighting device 10 according to this embodiment.

First, a detection unit detects the discharge lamp driving voltage at the time of normal lighting (step S100). In this embodiment, the discharge lamp driving voltage is detected by the operation detector 60.

Then, the history information storage 45 periodically stores the history information of the detected discharge lamp driving voltage (step S102). In this embodiment, the system controller 41 periodically writes the history information to the history information storage 45 of the memory unit 44. The writing period of the history information can be set to, for example, 5 minutes.

The statistics processing unit statistically processes the stored history information every predetermined period (step S104). In this embodiment, the system controller 41 performs the statistical process. The predetermined period can be set to, for example, 1 hour.

The statistical process may include one or more of an average process of taking an average value of the history information every predetermined period, a moving average process of taking a moving average value on the basis of a predetermined number of latest average values of the history information, a standard error process of taking a standard error on the basis of a predetermined number of latest moving average values, a standard deviation process of taking a standard deviation of the history information every predetermined period, a variance process of taking a variance of the history information every predetermined period, a maximum value process of taking a maximum value of the average values of the history information on the basis of a predetermined number of latest average values of the history information, and a minimum value process of taking a minimum value of the average values of the history information on the basis of a predetermined number of latest average values of the history information.

In step S104, the statistics processing unit may sequentially delete the history information of the discharge lamp driving voltage used for the statistical process. Accordingly, the memory area of the history information storage can be saved.

The statistical information storage 46 stores the information having been subjected to the statistical process as statistical information (step S106). In this embodiment, the system controller 41 periodically writes the statistical information in the statistical information storage 46 of the memory unit 44.

The control circuit 40 then determines whether a state for changing the driving conditions of the discharge lamp driving AC current I is satisfied on the basis of a time-dependent tendency of the statistical information (step S108). In this embodiment, the system controller 41 performs the determination. For example, the driving conditions may include one or more of a frequency, a duty ratio, and a waveform.

When the control circuit 40 determines that the condition for setting and changing the driving conditions of the discharge lamp driving AC current I is satisfied, a new driving condition is set to control the discharge lamp 90 (step S110) In this embodiment, the system controller 41 sets the new driving condition and controls the discharge lamp 90 under the new driving condition by controlling the power control circuit controller 42 and the AC conversion circuit controller 43.

When the control circuit 40 determines that the state for changing the driving conditions of the discharge lamp driving AC current I is not satisfied, the discharge lamp 90 is continuously driven without changing the driving conditions.

A specific example of the processes of steps S108 and S110 will be described now.

Figure 3:
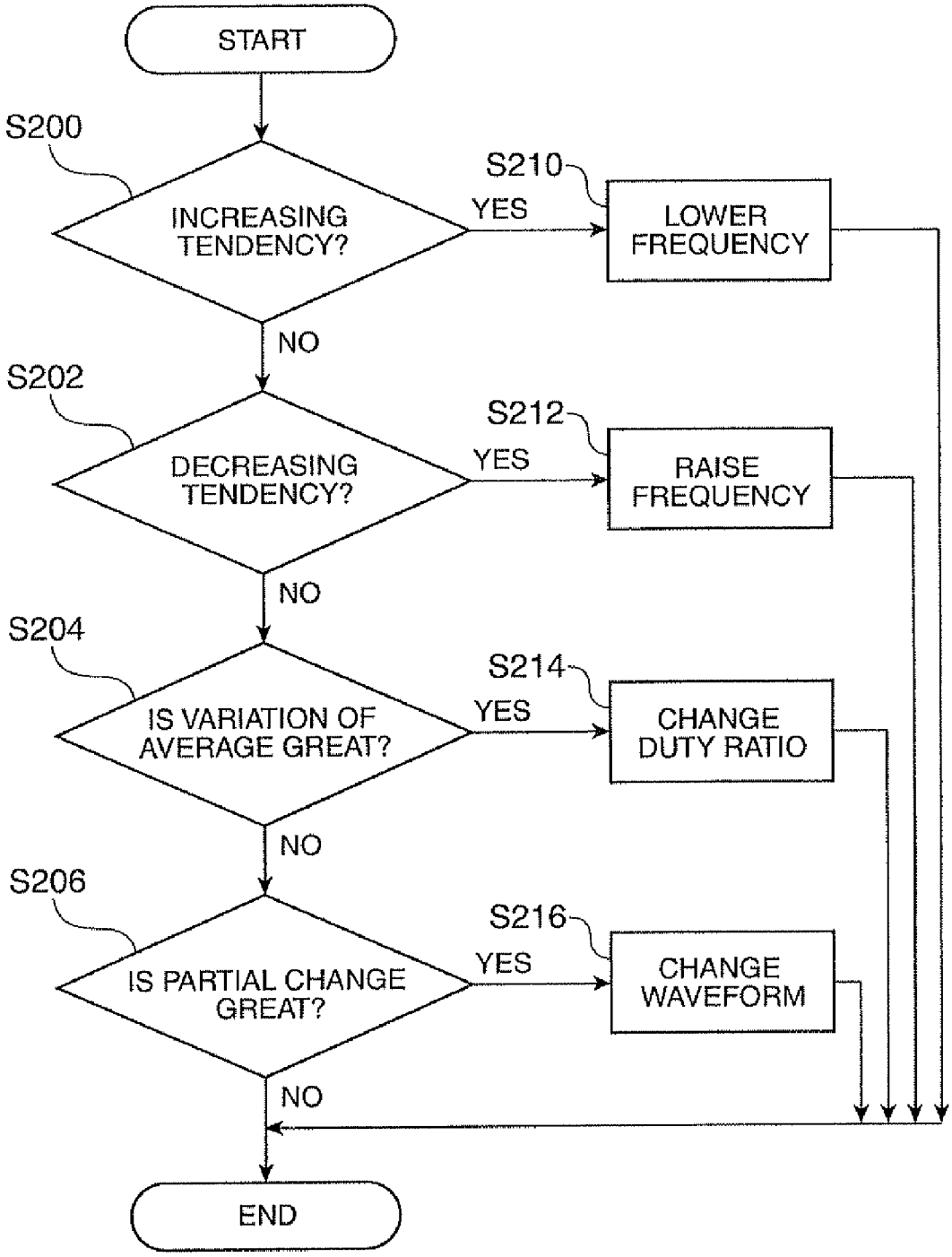
FIG. 3 is a diagram illustrating a control method of the discharge lamp lighting device according to the embodiment of the invention.

FIG. 3 is a flowchart illustrating an example of the processes of step S108 and S110. Steps S200 to S206 of FIG. 3 correspond to step S108 of FIG. 2 and steps S210 to S216 of FIG. 3 correspond to step S110 of FIG. 2.

Figure 4A:
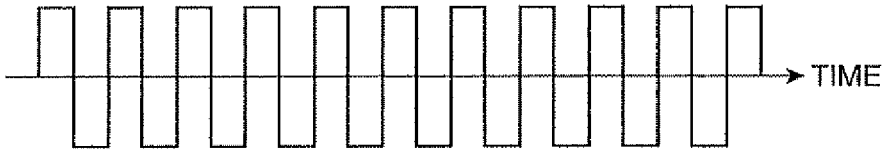
FIGS. 4A to 4D are diagrams illustrating the control method of the discharge lamp lighting device according to the embodiment of the invention.

FIGS. 4A to 4D show examples of the waveforms of the discharge lamp driving AC current I. The current waveform of the discharge lamp driving AC current I in the initial state is set to a rectangular wave having a duty ratio of 50% as shown in FIG. 4A.

First, the control circuit 40 determines whether the discharge lamp driving voltage exhibits an increasing tendency (step S200). The determination whether the discharge lamp driving voltage exhibits an increasing tendency may be made, for example, taking an average value of the history information every predetermined period in the average process, by taking a moving average value on the basis of a predetermined number of latest average values of the history information in the moving average process, and determining whether the moving average value is equal to or greater than an upper limit threshold value. The upper limit threshold value may be set in advance to a specific value or may be set to the first moving average value of +1 V.

By making the determination on the basis of the moving average value taken from a predetermined number of latest average values of the history information, it is possible to determine a long-term increasing tendency of the discharge lamp driving voltage without depending on a short-term variation of the discharge lamp driving voltage.

Figure 4B:
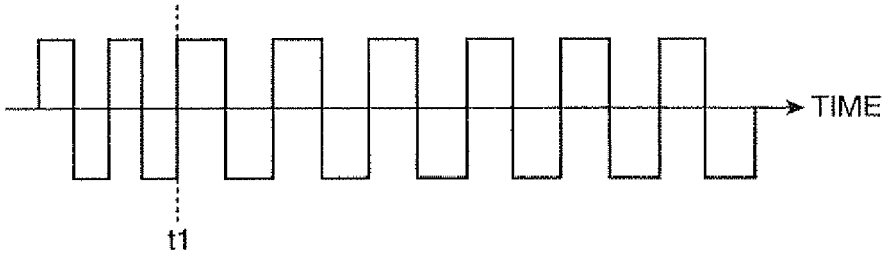

When it is determined that the discharge lamp driving voltage exhibits the increasing tendency, the control circuit 40 performs an AC conversion control process of lowering the frequency of the discharge lamp driving AC current I (step S210) For example, like the waveform shown in FIG. 4B, the AC conversion control process of lowering the frequency of the discharge lamp driving AC current I is performed at time t1.

Since the electrode temperature is raised by lowering the frequency of the discharge lamp driving AC current I, the melting of the electrode is promoted to suppress a decrease in the distance between the electrodes, thereby suppressing an increase in the discharge lamp driving voltage.

When it is determined that the discharge lamp driving voltage does not exhibit the increasing tendency, the control circuit 40 determines whether the discharge lamp driving voltage exhibits a decreasing tendency (step S202). The determination whether the discharge lamp driving voltage exhibits a decreasing tendency may be made, for example, by taking an average value of the history information every predetermined period in the average process, taking a moving average value on the basis of a predetermined number of latest average values of the history information in the moving average process, and determining whether the moving average value is equal to or greater than a lower limit threshold value. The lower limit threshold value may be set in advance to a specific value or may be set to the first moving average value of −1 V.

By making the determination on the basis of the moving average value taken from a predetermined number of latest average values of the history information, it is possible to determine a long-term decreasing tendency of the discharge lamp driving voltage without depending on a short-term variation of the discharge lamp driving voltage.

Figure 4C:
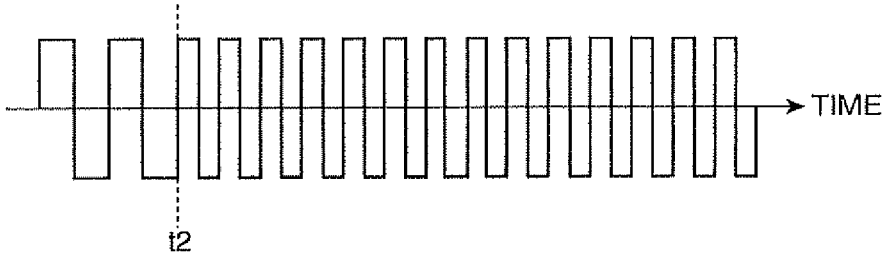
Figure 4D:
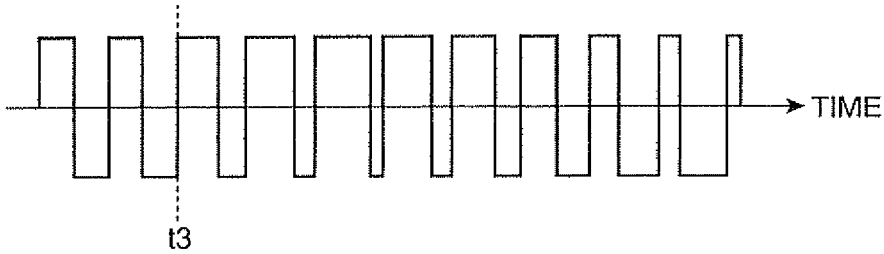

When it is determined that the discharge lamp driving voltage exhibits the decreasing tendency, the control circuit 40 performs an AC conversion control process of raising the frequency of the discharge lamp driving AC current I (step S212) For example, like the waveform shown in FIG. 4C, the AC conversion control process of raising the frequency of the discharge lamp driving AC current I is performed at time t2.

Since the electrode temperature is lowered by raising the frequency of the discharge lamp driving AC current I, excessive melting of the electrode is prevented. That is, increasing in the distance between the electrodes is suppressed, thereby suppressing a decrease in the discharge lamp driving voltage.

When it is determined that the discharge lamp driving voltage does not exhibit the decreasing tendency, the control circuit 40 determines whether the variation in average value of the discharge lamp driving voltage every predetermined period is great (step S204).

The determination whether the variation in average value of the discharge lamp driving voltage every predetermined period is great is made, for example, by taking a standard deviation of the history information every predetermined period in the standard deviation process and determining whether the standard deviation is equal to or greater than a threshold value. Alternatively, the determination may be made by taking a variance of the history information every predetermined period in the variance process and determining whether the variance is equal to or greater than a threshold value.

For example, the determination may be made by taking a standard error on the basis of a predetermined number of latest moving average values in the standard error process and determining whether standard error is equal to or greater than a threshold value.

Figures 5A, 5B:
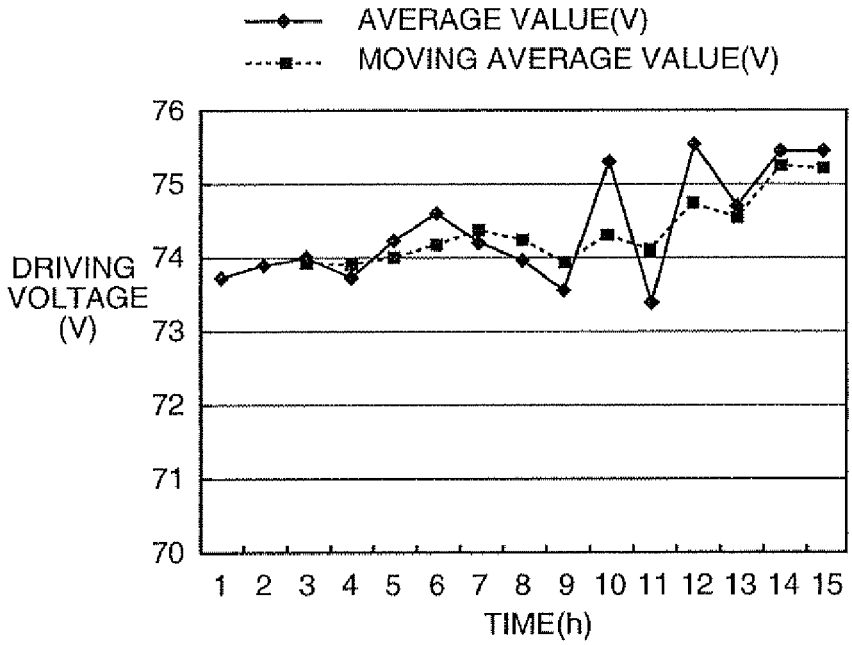
FIGS. 5A and 5B are diagrams illustrating the control method of the discharge lamp lighting device according to the embodiment of the invention.

FIG. 5A is a graph illustrating examples of the average values of the history information (average values of the discharge lamp driving voltage) and the moving average values thereof. In the drawing, the horizontal axis represents the time and the vertical axis represents the discharge lamp driving voltage.

FIG. 5B is a table showing the average values of the history information (average values of the discharge lamp driving voltage) corresponding to the graph shown in FIG. 5A, the moving average values thereof, and the standard errors of the moving average values.

In this example, the average value of the discharge lamp driving voltage is taken every hour. The moving average value is taken on the basis of three latest average values of the history information. The standard error is taken on the basis of three latest moving average values.

In the graph shown in FIG. 5A, it is considered that the average values of the history information (average values of the discharge lamp driving voltage) have a relatively small variation from the first hour to the ninth hour, but the average values of the history information (average values of the discharge lamp driving voltage) have a relatively large variation from the tenth hour to the fourteenth hour. From the tenth hour to the fourteenth hour when the variation is large, the standard error of the moving average values is also relatively great.

Accordingly, for example, when the standard error is 0.4 V or more, it may be determined that the variation in average value of the discharge lamp driving voltage every predetermined period is great.

When it is determined that the variation in average value of the discharge lamp driving voltage every predetermined period is great, the control circuit 40 performs an AC conversion control process of changing the duty ratio of the discharge lamp driving AC current I in a periodic pattern (step S214). For example, like the waveform shown in FIG. 4D, the AC conversion control process of changing the duty ratio of the discharge lamp driving AC current I in a periodic pattern is performed at time t3. In the waveform shown in FIG. 4D, an AC conversion control process of changing the duty ratio in a periodic pattern in the range of 80% to 20% is performed.

By changing the duty ratio of the discharge lamp driving AC current I in a periodic pattern, the thermal condition of both electrodes of the discharge lamp 90 and the periphery of both electrodes can be changed. Accordingly, it is possible to suppress that both electrodes are partially consumed or to suppress that the electrode material is partially extracted. Therefore, it is possible to prevent the variation in average value of the discharge lamp driving voltage every predetermined period.

When it is determined that the variation in average value of the discharge lamp driving voltage every predetermined period is not great, the control circuit 40 determines whether a part of the average value of the discharge lamp driving voltage every predetermined time is greatly varied in a period of time including the plural predetermined periods (step S206). The determination whether a part of the average value of the discharge lamp driving voltage every predetermined time is greatly varied may be made, for example, by determining whether a difference between the maximum value and the minimum value of the average values of the history information taken on the basis of a predetermined number of latest average values of the history information is equal to or greater than a threshold value.

When it is determined that a part of the average value of the discharge lamp driving voltage every predetermined time is greatly varied in the period of time including the plural predetermined periods, the control circuit 40 performs an interval current control process of changing the waveform of the discharge lamp driving AC current I (step S216).

Figure 6A:
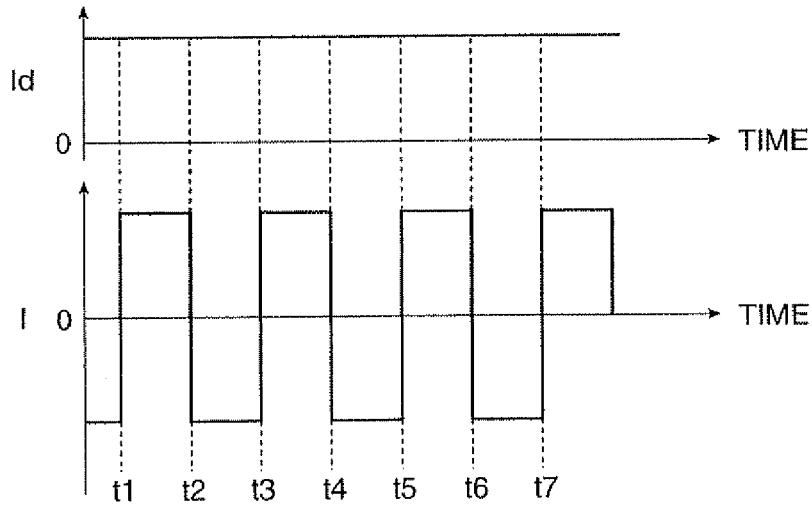
FIGS. 6A, 6B, and 6C are diagrams illustrating the control method of the discharge lamp lighting device according to the embodiment of the invention.
Figure 6B:
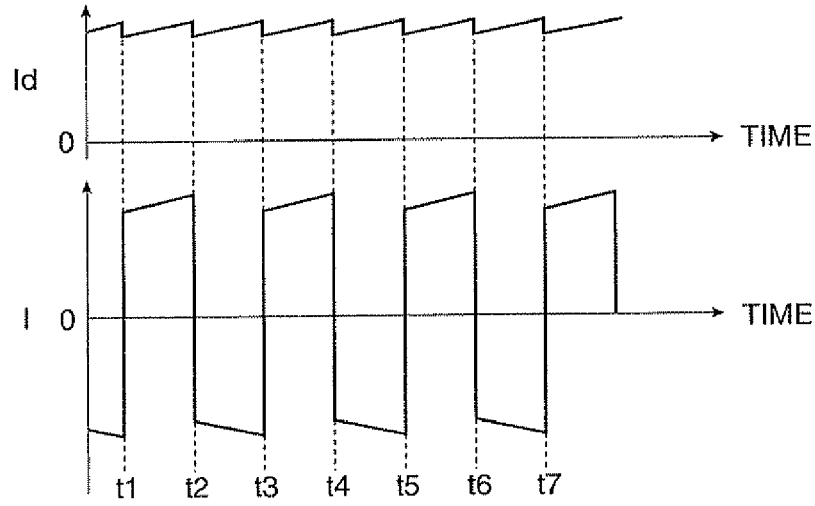
Figure 6C:
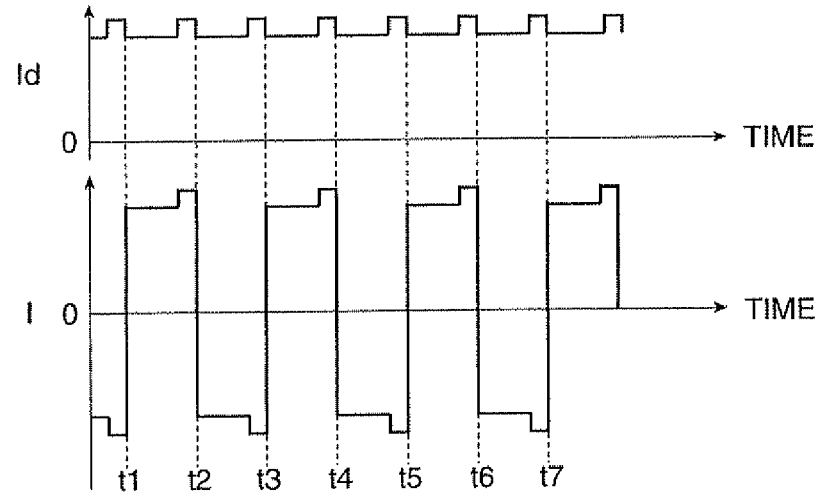

FIGS. 6A to 6C are diagrams illustrating examples of the waveforms of the DC current Id output from the power control circuit 20 and the discharge lamp driving AC current I. In the drawings, the horizontal axis represents the time and the vertical axis represents the current value. Times t1 to t7 represent the polarity inversion timing of the discharge lamp driving AC current I.

The waveforms shown in FIG. 6A are waveforms when the control circuit 40 performs the interval current control process of keeping the DC current Id output from the power control circuit 20 constant in the polarity inversion timing interval.

The waveforms shown in FIG. 6B are waveforms when the control circuit 40 performs the interval current control process of linearly monotonously increasing the current value of the DC current Id output from the power control circuit 20 in the polarity inversion timing interval.

The waveforms shown in FIG. 6C are waveforms when the control circuit 40 performs the interval current control process of step-like increasing the current value of the DC current Id output from the power control circuit 20 in the polarity inversion timing interval.

Like the waveform shown in FIG. 6B or the waveform shown in FIG. 5C, by increasing the current value of the discharge lamp driving AC current I in the second half of a semi-period of the discharge lamp driving AC current, the temperature of the discharge lamp electrodes can be raised and the ends of the electrodes can be melted, thereby smoothing the electrode shape. Accordingly, it is possible to stabilize the discharge position and to suppress the variation in discharge lamp driving voltage or the variation in brightness due to the occurrence of flickers or the like.

Accordingly, by changing the interval current control process, which is performed in the initial state so that the discharge lamp driving AC current I has the waveform shown in FIG. 5A, so as to set the discharge lamp driving AC current I to the waveform shown in FIG. 6B or the waveform shown in FIG. 6C, it is possible to prevent the great variation appearing in a part of the average value of the discharge lamp driving voltage every predetermined period.

Figure 7:
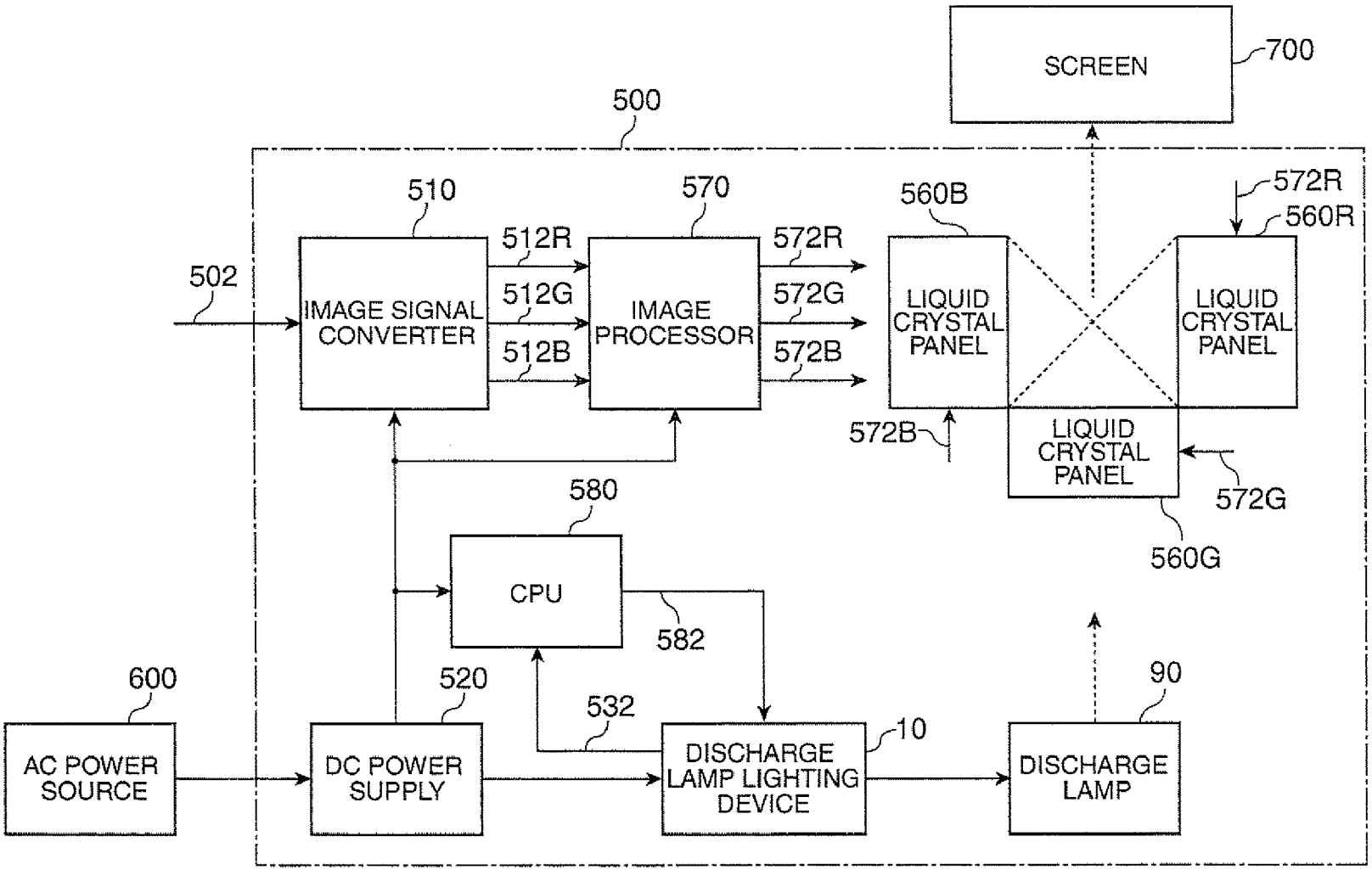
FIG. 7 is a diagram illustrating a configuration of a projector according to an embodiment of the invention.

In this way, by allowing the control circuit 40 to set and control one or more of the frequency, the duty ratio, and the waveform of the discharge lamp driving AC current I on the basis of the time-dependent tendency of the statistical information, it is possible more properly set the driving conditions of the discharge lamp 90. Therefore, it is possible to embody a discharge lamp lighting device capable of stably driving a discharge lamp for a long time. ps 2. Projector FIG. 7 is a diagram illustrating a circuit configuration of a projector according to this embodiment. The projector 500 includes an image signal converter 510, a DC power supply 520, a discharge lamp lighting device 10, a discharge lamp 90, liquid crystal panels 560R, 560G, and 560B, and an image processor 570, in addition to an optical system not shown.

The image signal converter 510 converts an image signal 502 (such as a brightness-chrominance signal or an analog ROB signal) input from the outside into a digital RGB signal having a predetermined word length to generate image signals 512R, 512G, and 512B and supplies the generated image signals to the image processor 570.

The image processor 570 performs an image process to three image signals 512R, 512G, and 512B and outputs driving signals 572R, 572G, and 572B for driving the liquid crystal panels 560R, 560G, and 560B, respectively.

The DC power supply 520 converts an AC voltage supplied from an external AC power supply 600 into a constant DC voltage and supplies the DC voltage to the image signal converter 510 and the image processor 570 disposed on the secondary side of a transformer (included in the DC power supply 520 although not shown), and the discharge lamp lighting device 10 disposed on the primary side of the transformer.

The discharge lamp lighting device 10 generates a high voltage between the electrodes of the discharge lamp 90 at the time of starting up and breaks down the insulation to form a discharge path and supplies driving current for allowing the discharge lamp 90 to maintain a discharge.

Images based on the driving signals 572R, 572G, and 572B are displayed on the liquid crystal panels 560R, 560G, and 560B and the brightness of color beams incident on the liquid crystal panels is modulated by the images.

A CPU 580 controls operations from the start of lighting of the projector to the extinction. When the projector is turned on and the output voltage of the DC power supply 520 reaches a predetermined value, a lighting signal 582 is generated and is supplied to the discharge lamp lighting device 10. The CPU 580 may receive lighting information 532 of the discharge lamp 90 from the discharge lamp lighting device 10.

In the projector 500 having the above-mentioned configuration, it is possible to more properly set the driving conditions of the discharge lamp 90 by setting and controlling at least one of the frequency, the duty ratio, and the waveform of the discharge lamp driving AC current I on the basis of the time-dependent tendency of the statistical information. Accordingly, it is possible to embody a projector that can drive a discharge lamp in a stable status for a long time.

The invention is not limited to the above-mentioned embodiments, but may be modified in various forms without departing from the gist of the invention.

Although the projector employing three liquid crystal panels has been described in the above-mentioned embodiments, the invention is not limited to the embodiments, but may be applied to projectors employing one, two, or four or more liquid crystal panels.

Although a transmissive projector has been described in the above-mentioned embodiments, the invention is not limited to the embodiments, but may be applied to a reflective projector. Here, the "transmissive" means a type in which an electro-optical modulator as a light modulator such as a transmissive liquid crystal panel transmits light and the "reflective" means a type in which an electro-optical modulator as a light modulator such as a reflective liquid crystal panel or a micro-mirror light modulator reflects light. For example, a DMD (Digital Micro mirror Device) (trademark of Texas Instrument) can be used as the micro-mirror light modulator. When the invention is applied to the reflective projector, it is also possible to obtain the same advantages as the transmissive projector.

The invention may be applied to a front projection type projector projecting a projection image from an observer side and a rear projection type projector projecting a projection image from an opposite side of the observer side.

The invention is not limited to the above-mentioned embodiments, but may be modified in various forms without departing from the gist of the invention.

The invention includes substantially the same configurations (for example, the same configurations in function, method, and result or the same configurations in object and advantage) as described in the above-mentioned embodiments. The invention also includes configurations obtained by replacing elements not essential to the configuration described in the embodiments. The invention also includes configurations having the same operational advantages as the configuration described in the embodiments or configurations capable of accomplishing the same object as the configuration described in the embodiments. The invention also includes configurations obtained by adding known techniques to the configuration described in the embodiments.

What is claimed is:

1. A discharge lamp lighting device comprising:

a power control circuit outputting DC current;

an AC conversion circuit generating and outputting discharge lamp driving AC current by inverting the polarity of the DC current at a predetermined timing;

a control circuit performing an AC conversion control process of controlling a polarity inversion timing of the discharge lamp driving AC current on the AC conversion circuit and performing an interval current control process of controlling a current value of the DC current every polarity inversion timing interval on the power control circuit;

a detection unit detecting a discharge lamp driving voltage at the time of normal lighting;

a history information storage periodically storing history information of the detected discharge lamp driving voltage;

a statistics processing unit statistically processing the stored history information every predetermined period; and a statistical information storage storing information having been subjected to the statistical process as statistical information, wherein the control circuit sets and controls at least one of a frequency, a duty ratio, and a waveform of the discharge lamp driving AC current on the basis of a time-dependent tendency of the statistical information.

2. The discharge lamp lighting device according to claim 1, wherein the history information storage and the statistical information storage hold information after putting out the discharge lamp.

3. The discharge lamp lighting device according to claim 1, wherein the statistics processing unit erases the history information used for the statistical process.

4. The discharge lamp lighting device according to claim 1, wherein the statistical process includes an average process of taking an average value of the history information every predetermined period.

5. The discharge lamp lighting device according to claim 4, wherein the statistical process includes a moving average process of taking a moving average value on the basis of a predetermined number of latest average values.

6. The discharge lamp lighting device according to claim 5, wherein the statistical process includes a standard error process of taking a standard error on the basis of a predetermined number of latest moving average values.

7. The discharge lamp lighting device according to claim 1, wherein the statistical process includes at least one of a standard deviation process of taking a standard deviation of the history information every predetermined period and a variance process of taking a variance of the history information every predetermined period.

8. The discharge lamp lighting device according to claim 1, wherein the statistical process includes at least one of a maximum value process of taking a maximum value of average values on the basis of a predetermined number of latest average values and a minimum value process of taking a minimum value of the average values on the basis of a predetermined number of latest average values.

9. A projector comprising the discharge lamp lighting device according to claim 1.

10. A control method of a discharge lamp lighting device having a power control circuit outputting DC current and an AC conversion circuit generating and outputting discharge lamp driving AC current by inverting the polarity of the DC current at a predetermined timing, the control method comprising:

performing an AC conversion control process of controlling a polarity inversion timing of the discharge lamp driving AC current on the AC conversion circuit and performing an interval current control process of controlling a current value of the DC current every polarity inversion timing interval on the power control circuit;

detecting a discharge lamp driving voltage at the time of normal lighting;

periodically storing history information of the detected discharge lamp driving voltage;

statistically processing the stored history information every predetermined period; and storing information having been subjected to the statistical process as statistical information, wherein the performing of an AC conversion control process and an interval current control process includes setting at least one of a frequency, a duty ratio, and a waveform of the discharge lamp driving AC current on the basis of a time-dependent tendency of the statistical information.

* * * * *